United States Patent [19]

Baker et al.

[11] Patent Number: 4,695,418

[45] Date of Patent: Sep. 22, 1987

[54] METHOD AND APPARATUS FOR MANUFACTURING ROOF TILES AND TILES MADE THEREBY

[75] Inventors: Robin M. Baker, Horsham; Paul R. Sargeant, Wisborough Green; Ernest G. Papper, Crawley; Bhusan K. Oberoi, Horley; Frank A. Smith, Godstone; Malcolm C. Rae, Reigate, all of United Kingdom

[73] Assignee: Redland Roof Tiles Limited, Surrey, United Kingdom

[21] Appl. No.: 775,413

[22] Filed: Sep. 12, 1985

[30] Foreign Application Priority Data

Sep. 12, 1984 [GB] United Kingdom ..... 8423048

[51] Int. Cl.[4] ..... B28B 11/12

[52] U.S. Cl. ..... 264/151; 264/162; 264/239; 264/296; 425/220; 425/304

[58] Field of Search ..... 264/151, 162, 145, 239, 264/296; 425/220, 304

[56] References Cited

U.S. PATENT DOCUMENTS

| | | | |
|---|---|---|---|
| 753,981 | 3/1904 | Hoelsche | 425/304 X |
| 782,483 | 2/1905 | Cammeyer | 264/296 |
| 1,619,489 | 3/1927 | Schwarz et al. | 264/296 X |
| 2,644,217 | 7/1953 | Agar | 264/296 X |
| 3,268,637 | 8/1966 | Cremer | 264/296 X |
| 3,354,842 | 11/1967 | Manspeaker | 425/304 X |

FOREIGN PATENT DOCUMENTS

| | | | |
|---|---|---|---|
| 731401 | 9/1932 | France | 264/139 |
| 936728 | 9/1963 | United Kingdom | 264/139 |
| 1577321 | 10/1980 | United Kingdom | 264/151 |

*Primary Examiner*—Philip Anderson

*Attorney, Agent, or Firm*—Beveridge, DeGrandi & Weilacher

[57] ABSTRACT

In the manufacture of roof tiles comprising extruding a continuous shaped ribbon of tile forming material onto a succession of pallets, and cutting the ribbon where pallets adjoin to form individual green state tiles on pallets, there is performed the step of causing a cutting tool to engage with the upper surface of the ribbon only for part of the length of each pallet whereby a recess is formed in the upper surface of each tile. In a particular embodiment the recess is a channel cut in the tile at a location immediately downstream of the extruding step. The recess is also subsequently smoothed by applying a smoothing roll thereto.

26 Claims, 16 Drawing Figures

METHOD AND APPARATUS FOR MANUFACTURING ROOF TILES AND TILES MADE THEREBY

This invention relates to a method and apparatus for manufacturing roof tiles and tiles made thereby.

Whereas early production methods for the manufacture of concrete roof tiles of a multiplicity of different shapes and sizes, incorporated the use of unsophisticated platen presses wherein a measured quantity of a concrete mix was pressed between the two halves of a mould, the high speed extrusion processes utilised today have to be capable of producing in excess of one hundred and twenty tiles per minute.

In tile making processes, which are typical of those carried out on modern plant, tiles are produced by passing a continuous stream of pallets through a tile making section whereat mortar from a hopper loaded with such mortar is pressed onto the pallets by a "roller" and complementary "slipper" located within the hopper to form a ribbon of mortar on the pallets. The "roller" and "slipper" define the upper surface of the ribbon of mortar while the tile pallets define the undersurface thereof. The ribbon of mortar, thus defined, is thereafter subjected to the cutting action of an appropriate knife mechanism to separate the ribbon into individual green state concrete tiles supported by their respective pallets. Curing and depalleting operations are effected and the cured tiles are stored before use.

The upper surface of tiles produced by these processes may be "planar", i.e. flat, or shaped e.g. the tile may be provided with a "roll" extending widthwise of the tile. Such shaped tiles may be known as "Roman" tiles. It is obvious that the upper surfaces of the tiles will be of the same configuration along their whole length because they are formed by an extrusion process.

According to the invention there is provided a method of manufacturing roof tiles comprising extruding a continuous shaped ribbon of tile forming material onto a succession of pallets, and cutting the ribbon where pallets adjoin to form individual green state tiles on pallets, wherein the method includes the step of causing a cutting tool to engage with the upper surface of the ribbon only for part of the length of each pallet whereby a recess is formed in the upper surface of each tile. The tile forming material is preferably concrete, but the invention is also applicable to other tile forming materials suitable for an extrusion process.

Preferably, during the recess forming step, at least part of the tile forming material disposed adjacent the material engaged by the cutting tool is mechanically supported to resist deformation of said adjacent material.

In one embodiment of the invention the recess formed by the cutting tool in the upper surface of each tile is a channel extending lengthwise of the tile but across only part of the width of the tile. Alternatively the recess may extend across the whole of the tile width.

Preferably the recess forming step is performed at the trailing end of each tile in such a manner that the leading end of the succeeding tile is unimpaired.

It is also preferred that the recess forming step is performed on successive tile portions of the ribbon before the ribbon is cut into discrete lengths. In this case the last stage of the extruding step may include pressing the ribbon being formed beneath a stationary slipper in conventional manner, the recess forming step being performed immediately downstream of the extruding step, said slipper serving to provide support and thereby resist undesired movement of the ribbon material upstream of the material being removed.

In another embodiment of the invention the recess forming step is performed after the ribbon has been cut into discrete lengths and the individual tiles have been spaced apart, the recess forming step being performed at the leading end of each tile. In this case, the pallets and the tiles thereon may be turned through 180°, between the ribbon cutting step and the recess forming step, so that the recess is still formed in the same end of the resultant tile as in the preferred embodiment described above.

Preferably the method includes, subsequent to the recess forming step, the additional step of causing a smoothing tool to engage with the surface of the recess in each tile. Also, during the smoothing step, at least part of the tile disposed adjacent the recess may be mechanically supported to resist deformation thereof.

The invention also provides apparatus for manufacturing roof tiles comprising means for extruding a continuous shaped ribbon of tile forming material onto a succession of pallets, and means for cutting the ribbon where pallets adjoin to form individual greed state tiles on pallets, wherein the apparatus includes a cutting tool which engages and disengages with the upper surface of the ribbon in synchronism with the pallets whereby a recess is formed in the upper surface of each tile over only part of its length.

It is preferred that support means are arranged to give support during the recess forming step to at least part of the tile forming material disposed adjacent the material engaged by the cutting tool, and thereby resist deformation of said adjacent material.

Preferably the cutting tool is a channelling tool which forms a channel extending lengthwise of each tile but across only part of the width of the tile.

The cutting tool may be a blade mounted transversely of the ribbon and carried by a support which allows the blade to move along an arcuate path to effect its cut in a direction opposite to the direction of movement of the ribbon.

It is preferred that the cutting tool has a reciprocatory action controlled by means which effect a quick return movement of the tool to disengage the tool at the completion of its cutting action. In this case, the cutting tool is preferably cam actuated, the shape of the cam determining the depth of cut at any given point along the length of the tile.

Conveyor means may be associated with the cutting tool to carry away the material removed thereby.

Preferably the cutting tool is disposed immediately downstream of the extrusion means and prior to the ribbon cutting means. Alternatively the cutting tool may be disposed downstream of the ribbon cutting means. In either case, downstream of the ribbon cutting means, conveyor means may be provided for transporting the tiles, the conveyor means having dogs disposed at a distance one from the other which dogs effect a separation of successive pallets and the tiles thereon.

It is also preferred that the apparatus includes a smoothing tool disposed above the tiles and operable to effect a smoothing action on the surface of the recess in each tile. Preferably support means are arranged to give support during the smoothing step to at least part of the tile disposed adjacent the recess, and thereby resist deformation thereof.

The smoothing tool may be a roll extending transversely to the direction of movement of the tiles, there being provided drive means for rotating the roll and control means to engage and disengage the roll with each tile in synchronism therewith. Preferably the control means is a driven cam, the shape of the cam determining the vertical position of the smoothing roll relative to the tile beneath.

The invention further provides a roof tile manufactured by a method or apparatus as defined above.

By way of example, a specific method and apparatus in accordance with the invention for manufacturing roof tiles will be described with reference to the accompanying drawings in which.

Figure 1:
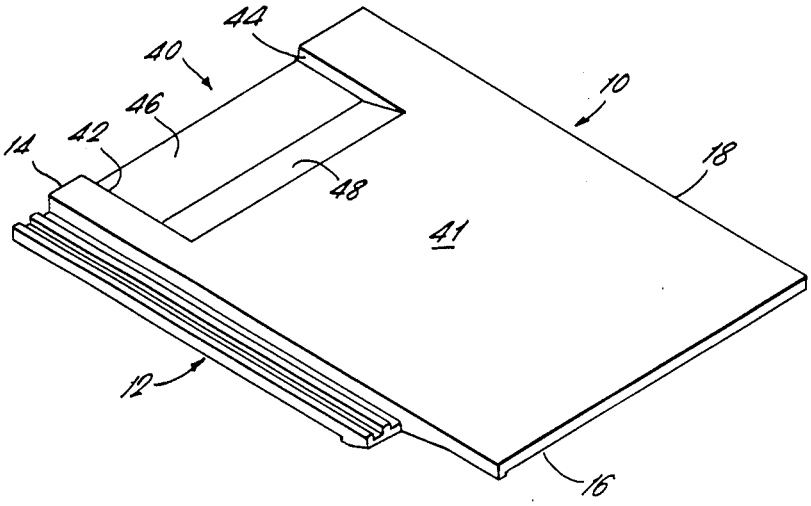
FIG. 1 is an upper perspective view of a tile produced on the apparatus of FIG. 3.
Figure 2:
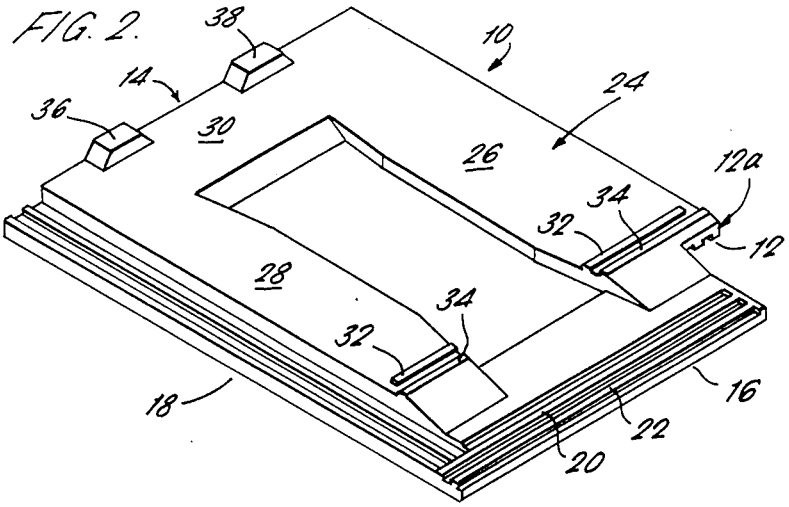
FIG. 2 is an underside perspective view of the tile of FIG. 1.
Figure 3A:
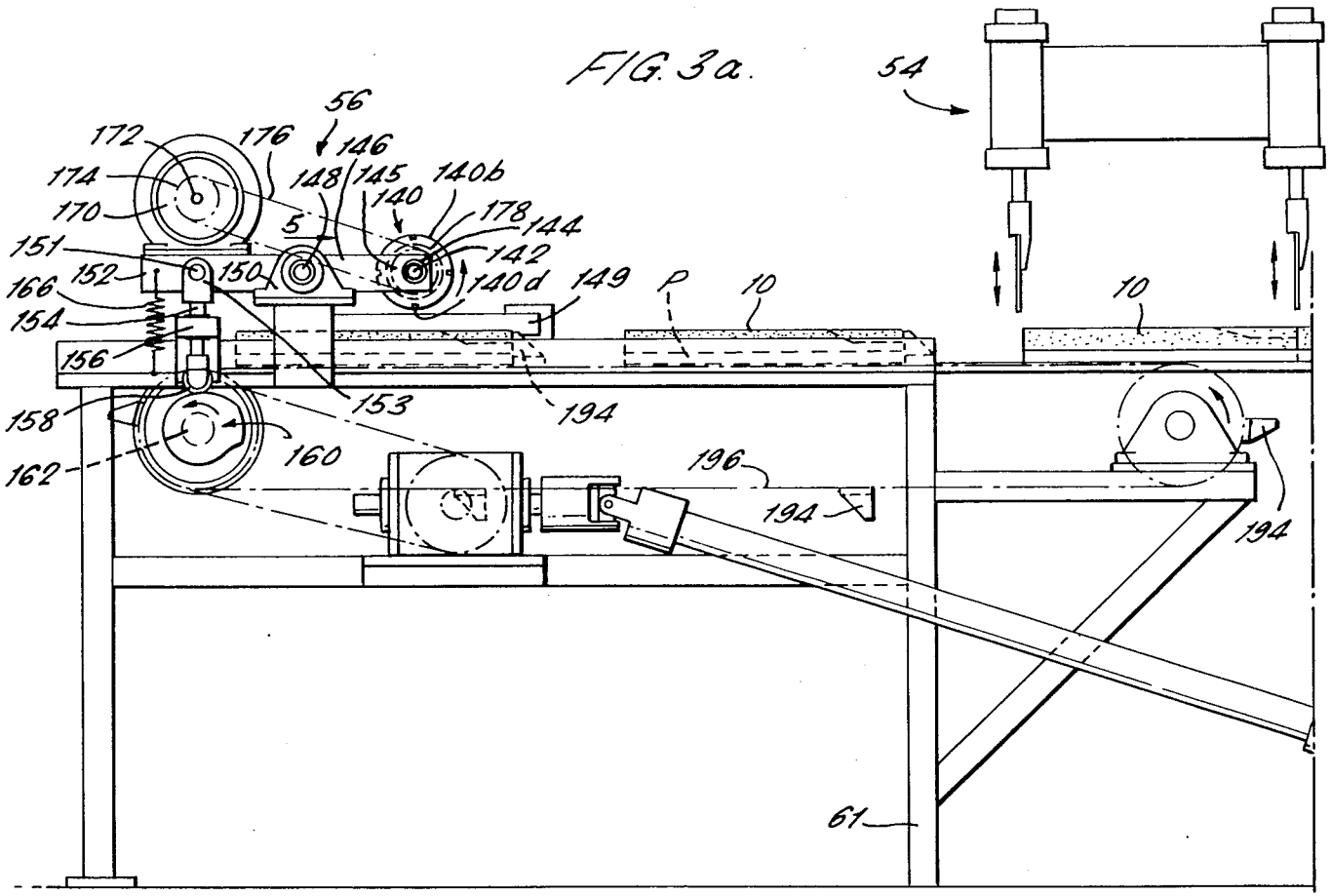
Figure 3B:
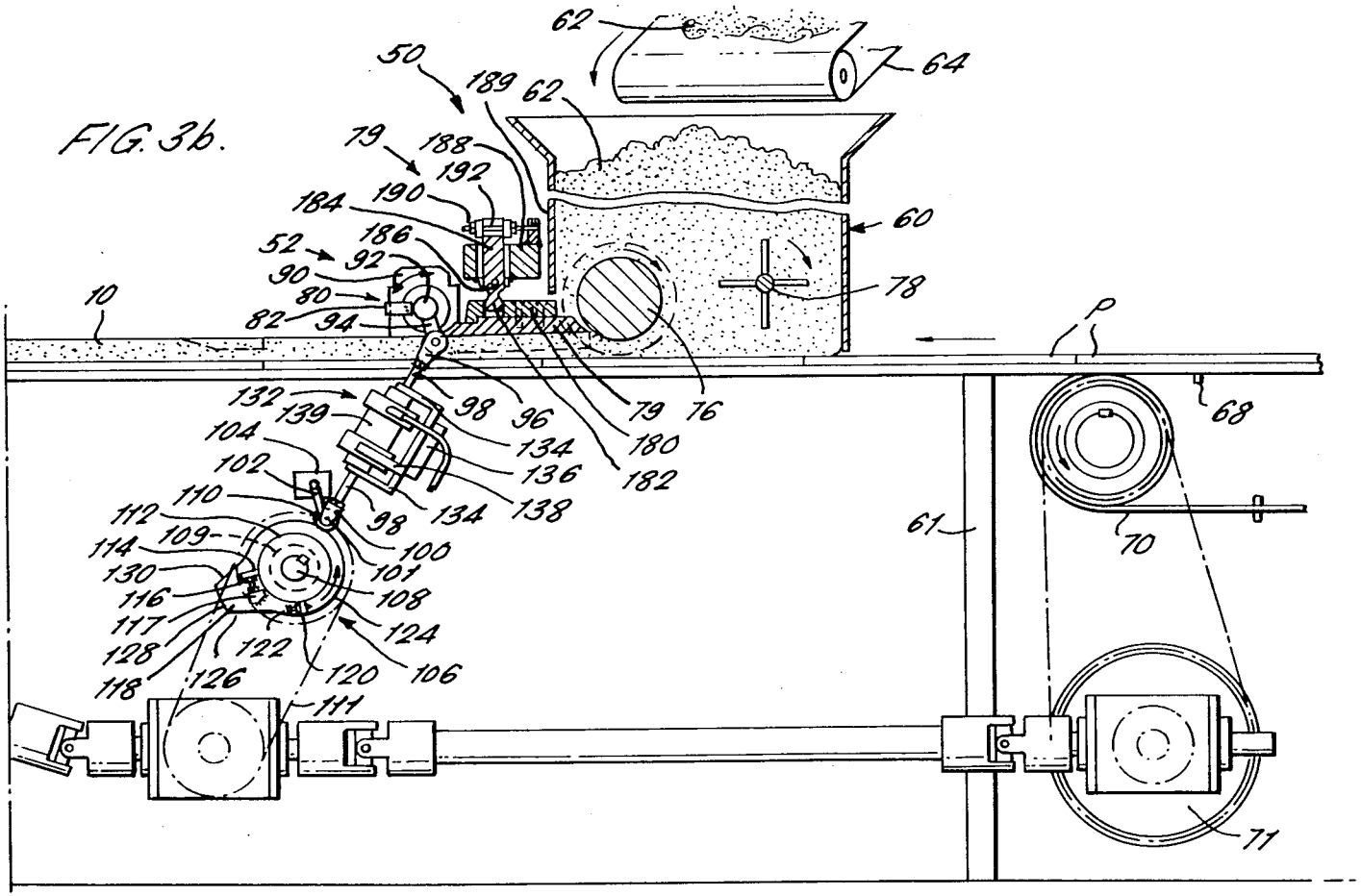
Figure 4:
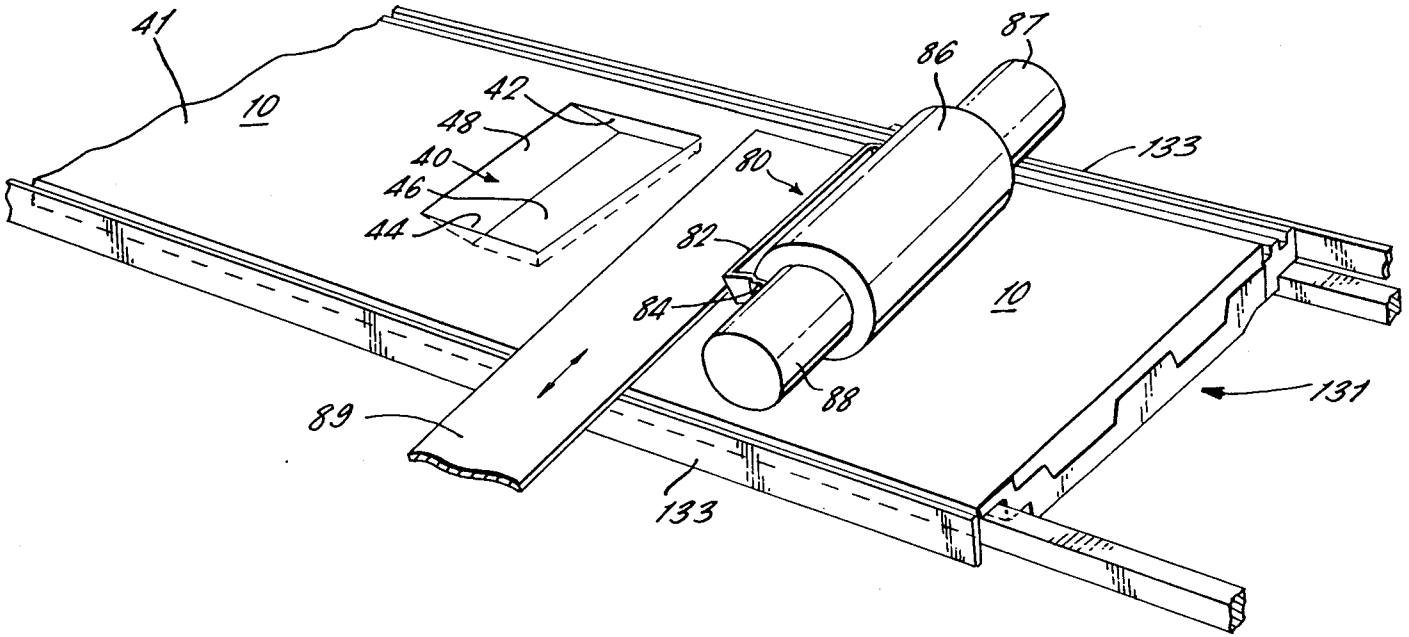
Figure 5:
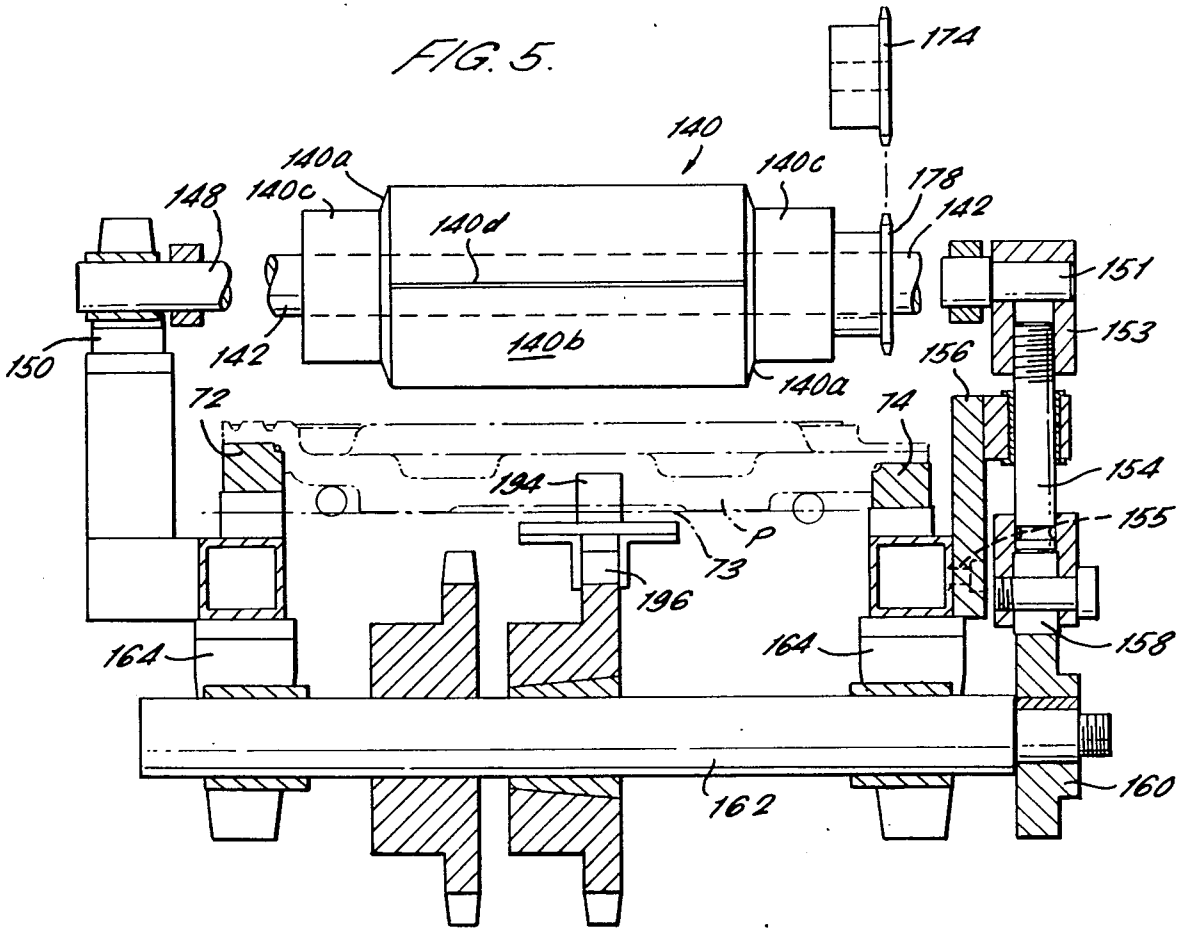

FIGS. 3*a* and 3*b* are complementary schematic side views (hereinafter referred to as FIG. 3) of the apparatus for producing the tile of FIGS. 1 and 2;

FIG. 4 is a schematic perspective view of the channelling tool of the apparatus of FIG. 3;

FIG. 5 is a transverse view, partly broken away, in the direction of arrow 5 in FIG. 3; and FIGS. 6*a* to 6*j* are timing diagrams representing in side elevation relative positions of the channelling tool and tiles being conveyed therepast.

This example concerns the manufacture of roof tiles formed by extruding tile forming material which will generally be concrete mortar but may be other extrudable material.

Similarly, this example is principally concerned with the manufacture of tiles having a generally planar configuration and in particular a novel tile described in our copending British Patent Application of even date entitled "Improvements in Roof Tiles". However, the production method and apparatus described hereinafter may be adapted for the production of tiles which are shaped in transverse cross-section.

The particular tile 10 of this example is generally rectangular in plan and comprises on the left hand side thereof, as seen in FIG. 1, a side lock portion 12 which faces upwardly and extends from the end 14 of the tile 10 which, in use, is its upper end, for about three-fourths or more but less than the full length of the tile, towards the lower end 16 thereof.

The tile 10 also comprises, on the right hand side thereof, as seen in FIG. 1, a side lock portion 18 which faces downwardly, in use, although it is seen facing upwardly in the underplan of FIG. 2, and extends for substantially the whole length of the tile 10. The portion 18 terminates short of the lower end 16 of the tile at a pair of horizontal ribs 20 and 22, which ribs extend across the undersurface of the tile adjacent the lower end 16 thereof. The ribs 20 and 22 strengthen the tile and act as weatherbars when tiles of the invention are arranged in overlapping arrangement on a roof.

The underside 24 of the tile 10 is shaped by the pallet P on which it is formed as described hereinafter and, although the tile so formed has a nominal thickness which is apparent from viewing the lower end 16 of the tile, it also comprises two thickened portions 26 and 28 which are located inwardly of the side lock portions 12 and 18 respectively. The portions 26 and 28 extend downwardly, from a thickened head portion 30 of the tile 10 to a position which is substantially coincident with a lower edge 12*a* of the side lock portion 12.

The portions 26 and 28 thus provide strength to the tile 10 and each has a pair of co-extensive parallel ribs 32 and 34 at its lower end portion. The ribs 32 and 34 add further strength to the tile 10 and also act as weatherbars when tiles of the invention are arranged in overlapping arangement on a roof.

At the head of the tile 10, on the underside thereof, hanging ribs 36 and 38 of known configuration are provided whereby the tile may be hung from roof battens in the conventional manner.

The tile 10 further comprises a recess or channel 40 formed as hereinafter described in its upper surface 41 and extending from the upper end 14 thereof, see FIG. 1. The channel 40 is open ended at the upper end 14 of the tile and comprises angled side walls 42 and 44 adjacent the side lock portions 12 and 18 respectively. The channel 40 also has a level floor portion 46 extending between the side walls 42 and 44 which floor portion 46 leads to an inclined portion 48 of the channel which extends to a position which is flush with the upper surface 41 of the tile (FIG. 1).

Referring to FIGS. 3 to 6, the tile manufacturing apparatus generally comprises a tile making section 50 incorporating a channelling device 52 by which, when the apparatus is in use, the channel 40 is formed in the upper surfaces 41 of successive tiles 10. The apparatus further comprises a knife mechanism 54 adapted for use in separating the tiles 10 formed at the making section and a smoothing roll attachment 56 for finishing the channel 40 cut by the channelling device 52. The knife mechanism 54 also cuts out the portion 12*a* of the side lock portion 12.

The tile making section 50 is of conventional design and comprises a hopper 60 supported on a floor mounted mainframe 61 of the apparatus. The hopper 60 is fed with concrete mortar 62 from a moving belt 64 and tile pallets P are conveyed in a continuous stream beneath the hopper 60 by dogs 68 of a conventional chain conveyor 70 driven by an electric motor 71. In their passage through the apparatus the pallets P are supported on slideways 72 and 74 mounted on the mainframe 61, see FIG. 5.

The hopper 60 is provided with a driven roller 76 and pack-shaft 78 in known manner, see FIG. 3. Also downstream of the roller 76 is an adjustable slipper 79 which serves to support the mortar and provide a smooth upper surface on each tile. The slipper will be further described in more detail hereinafter.

The channelling device 52 comprises a channelling tool 80, see FIGS. 3 and 4, which tool 80 is formed by a blade 82 of "goal post" configuration which is fixedly secured by screws 84 to a carrier roll 86. The length of the blade 82 is equivalent to the width of channel required. On the other hand, if it is required to cut a channel or recess across the full width of the tile, the blade could have a length greater than the tile width.

A vibrating conveyor 89 (shown diagrammatically in FIG. 4) is provided for taking away the mortar received by the channelling tool 80 from each successive tile during the recess forming step, the mortar passing upwardly between the blade 82 and the carrier roll 86 onto the conveyor surface.

The carrier roll 86 of the channelling tool 80 comprises reduced diameter shaft portions 87, 88 at opposite ends thereof by which it is rotatably mounted in aligned bearing brackets 90 secured to opposite sides of the mainframe 61, only one of which brackets 90 being shown in FIG. 3. Fixedly mounted on a reduced outer end portion 92 of the shaft portion 88 is a connecting link 94.

The link 94 extends downwardly and to the right, and is received in a bifurcated end portion 96 of a connecting rod 98. The opposite bifurcated end 100 of the rod 98 is pivotally connected by a pin 101 to a short link 102. The link 102 is pivotally mounted in a bearing bracket 104, the arrangement being such that the links 94 and 104 have at least a substantially mutual parallel relationship.

The channelling device 52 also comprises a lost motion cam 106 freely mounted on a journal bearing 109 of a drive collar 112. The drive collar 112 is fixedly mounted on a driven shaft 108, mounted in bearings, not shown, provided in the mainframe of the apparatus for rotation in an anti-clockwise direction as shown in FIG. 3.

The cam 106 is arranged to be engaged by a roll 110 rotatably mounted on the pin 101 in the bifurcated end 100 of the connecting rod 98.

The shaft 108 is driven by a drive connection 111 from the drive to the pallet feeding conveyor 70 to achieve synchronism between the operation of the cam 106 and hence the blade 82 and the pallets.

The drive collar 112 is also provided with a first radially extending abutment 114 so arranged that, when the apparatus is in use, it can be moved into driving engagement with an adjustable stop stud 116 provided in an abutment 117 extending from a side wall 118 of the cam 106.

The drive collar 112 is further provided with a second radially extending abutment 120 in which there is provided an adjustable stop stud 122, the purpose for which will be made clear hereinafter.

In this embodiment, the cam 106 comprises a dwell 124 of approximately 280°, a rise 126 of some 35°, a dwell 128 of 25° and a fall 130 of 20°.

The interaction of the drive collar 112, the abutment 114, the stop studs 116 and 122 and the cam 106 will be described hereinafter with reference to the operation of the apparatus and the timing diagrams of FIGS. 6*a* to 6*j*.

Associated with the connecting rod 98 is a piston and cylinder arrangement 132, the piston of which is fixedly mounted on the connecting rod 98 and fluid pressure is fed to one side only of the piston whereby, when the apparatus is in use, the rod 98 is moved upwardly by the cam 106 and downwardly by the fluid pressure.

As will be apparent the links 94 and 102 support the connecting rod 98 in such a way that, during the upward and downward movements thereof, the rod 98 is displaced laterally of its start and stop positions. To accommodate such movement the rod 98 is freely supported by slotted brackets 134 mounted on a support plate 136 fixedly secured to one side of the mainframe. In addition the plate 136 provides support for a side plate 138 which engages and supports a side 139 of the cylinder of the arrangement 132.

The above described control means for the blade 82 gives it a reciprocatory movement, the forward movement of the blade to engage the ribbon and to form a recess or channel therein being in the opposite direction to the direction of movement of the ribbon from beneath the slipper. The return movement to disengage the blade from the ribbon is a quick movement achieved by the provision of the piston and cylinder arrangement 132 and the free mounting of the cam 106 on the drive collar 112, whereby the blade does not foul the leading end of the succeeding tile. Moreover, during the cutting of the channel in each tile, it is desirable to provide mechanical support to the adjacent material to resist deformation of the material which may otherwise occur. In this embodiment, support against longitudinal deformation is given by a back wall 131 of the pallet (see FIG. 4) making contact with the trailing end of the tile and a degree of lateral support is given to each edge of the tile by check plates 133 extending for a short distance beyond the outlet of the slipper 79. Moerover, becuase the channelling device is located immediately downstream of the making section 50, it is found that the downward pressure applied by the slipper acts to support the material upstream of the recess being cut and thereby prevents deformation occurring.

The knife mechanism 54 for cutting the ribbon into discrete lengths to form individual green state tiles on their their associated pallets P is of conventional design and need not be described in detail. However, in this embodiment, the knife mechanism comprises two knives which are operated in unison, the upstream knife cutting the ribbon into discrete lengths in synchronism with the pallets, and the downstream knife trimming the leading end of each individual tile 10. Alternatively, the knife mechanism 54 may comprise the cutting knife only.

The smoothing roll attachment 56, see FIGS. 3 and 5, comprises a roll which extends over and across the path to be taken by pallets P carrying green state tiles through the apparatus. The roll 140 comprises reduced opposite end portions 142 by which it is rotatably mounted in bearings 144 carried in a bifurcated end portion 145 of a support platen 146.

The roll 140 also comprises chamfered end walls 140*a* leading from a peripheral surface 140*b* thereof to reduced diameter portions 140*c* the purpose of which will become clear hereinafter. In addition the peripheral surface 140*b* of the roll 140 is provided with at least four longitudinal slots 140*d*, the purpose of which will also be made clear hereinafter.

The platen 146 is mounted by fulcrum pins 148 thereof in two aligned bearing blocks 150 fixedly secured to opposite sides of the mainframe 61.

Pivotally connected by a pin 151 and link 153 to the plane 146 adjacent the end 152 remote from the roll 140 is a cam operated connecting rod 154, which is slidingly received in a pivotal bracket 156 mounted on the mainframe of the apparatus by a stud 155. At a lower end of the rod 154 there is rotatably mounted a cam roll 158 which is arranged to engage the periphery of a cam 160 which is in turn fixedly secured on a driven shaft 162 mounted in bearing brackets 164 secured to the mainframe of the apparatus.

In order to maintain contact between the cam roll 158 and the cam 160, a tension spring 166 is provided between the end 152 of the platen 146 and the mainframe 61.

The platen 146 also provides support for a motor 170 having an output shaft 172 and a sprocket 174 fixedly mounted thereon, which sprocket 174 is connected by an endless chain 176 to a sprocket 178 fixedly mounted at the right hand end portion, as seen in FIG. 5, of the roll 140. Thus, it will be appreciated that when the apparatus is in use and the motor 170 is energised, the roll 140 will be rotated in an anti-clockwise direction as viewed in FIG. 3, i.e. against the direction of movement of the tiles; in addition rotation of the cam 160 will cause movement of the roll 140 towards and away from the green state tiles passing therebeneath for a purpose to be described in full hereinafter. At this time the pivotal bracket 156 allows for arcuate movement of the pin 151 and the link 153 as the platen 146 is rocked about its fulcrum pins 148.

In the vicinity of the smoothing roll 140 and extending along one edge of the path taken by the tiles 10 on their pallets, the far edge as viewed in FIG. 3, there are disposed two stationary plates 149 (only one of which is shown) fixed in appropriate vertical planes, which plates serve to give lateral support to the tile material during smoothing of the channel 40. Upper surface portions of the tiles, widthwise of the channel 40, are subjected to the controlling effect of the cylindrical portions 140*c* of the smoothing roll 140. Lateral support on the near side of each tile as viewed in FIG. 3 is given by the construction of the pallet itself on which the tile rests. Furthermore, longitudinal support of the trailing end of each tile is provided by the back wall of the pallet. By this means, any deformation of the tile caused by the action of the smoothing roll which might otherwise occur, is avoided.

In constructing the apparatus is became evident that the channelling tool 80 should preferably be positioned immediately downstream of the slipper 79 in order to benefit from added support for the green state tiles when operated thereupon by the tool 80 as explained hereinbefore. Conventional slippers are arranged to be adjustable with respect to the rollers in the hoppers of tile making sections and such adjustment is usually achieved by appropriate brackets and adjustable screws extending in a downstream direction on the side of the hopper. Obviously, with the present arrangement this is not possible and, therefore, see FIG. 3, a novel solution is proposed for overcoming the problem.

The slipper 79, which is slidably mounted in guideways, not shown, is provided with an apertured capping plate 180 which is engaged by the lower end 182 of a pivoted lever 184. The lever 184 is pivoted at 186 in a bracket 188 secured to one side wall 189 of the hopper 60 and an adjustment stud 190 is provided in association with an end 192 of the lever remote from the end 182 whereby the slipper 79 may be moved towards and away from the roller 76 in the hopper 60.

The operation of the apparatus to produce roof tiles will now be described. A series of pallets P are fed in end to end relationship by the dogs 68 of the chain drive 70 towards the hopper 60 (see FIG. 3). Concrete mortar 62 in the hopper 60 is pressed into the pallets to form green state tiles 10, the roller 76 and the slipper 79 functioning in conventional manner to produce a continuous ribbon of mortar on the pallets P. At this time the pallets P are supported on the slides 72 and 74 and a central dead-bed section indicated by the chain dot line 73 in FIG. 5.

On the downstream side of the hopper 60 the pallets P continue to be moved by the dogs 68 of the drive chain 70 and tile portions 10*a*, 10*b*, etc of the ribbon of mortar on the pallets P are each provided with a channel 40 by the channelling tool 80. For each tile, the tool 80 is reciprocally operated, through the cam and linkage hereinbefore described, to follow a cycle comprising the sequence of actions shown diagrammatically in FIGS. 6*a* to 6*j*. The said sequence is controlled by the cam 106 which rotates in an anti-clockwise direction as seen in FIG. 3. While the roll 110 is in engagement with the dwell 124 of the cam 106, the blade 82 remains stationary in the raised position shown in FIG. 6*a*.

Figure 6A:
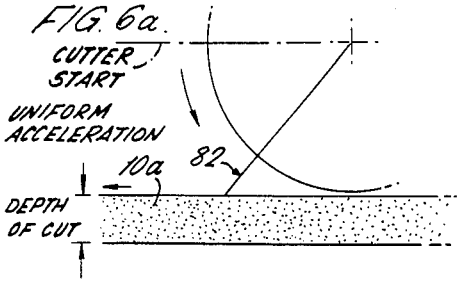
Figure 6B:
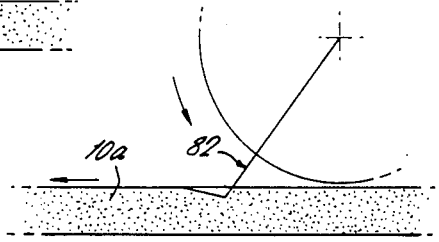
Figure 6C:
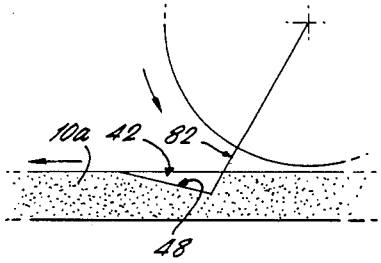
Figure 6D:
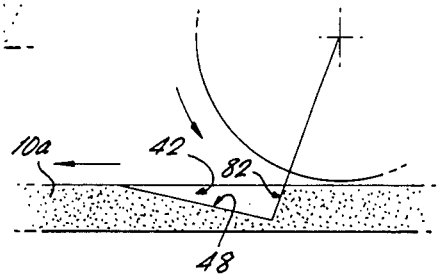
Figure 6E:
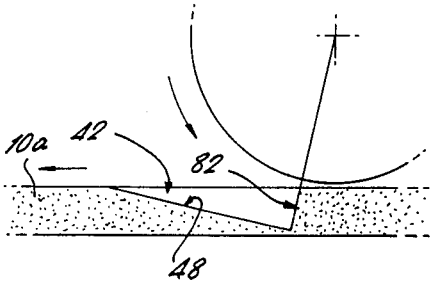
Figure 6F:
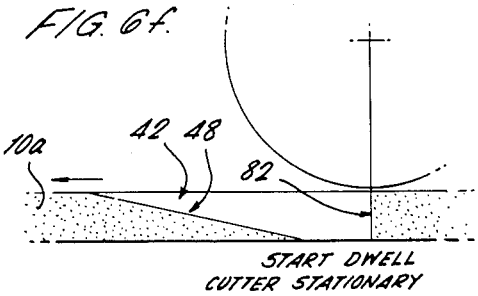

As the roll traverses the rise 126 of the cam 106, the blade 82 moves downwardly against the direction of movement of the tiles through the positions shown in FIGS. 6*b*, *c*, *d* and *e* to generate the inclined portion 48 of the channel 40 in a tile portion 10*a* and to reach the position shown in FIG. 6*f*. The roll 110 then traverses the dwell 128 during which time the blade 82 again remains stationary and cuts out the level floor portion 46 of the channel 40.

Figure 6G:
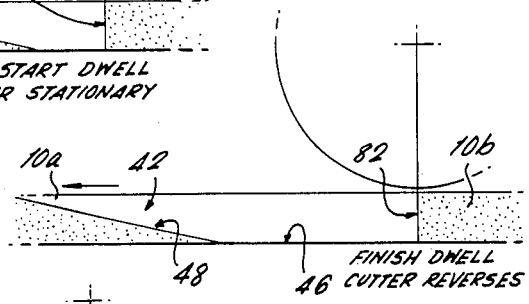
Figure 6H:
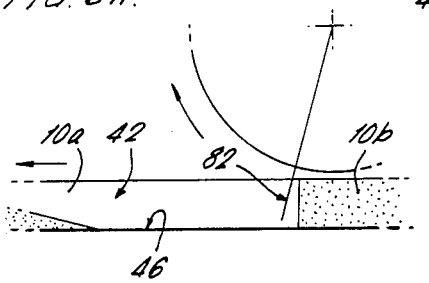
Figure 6I:
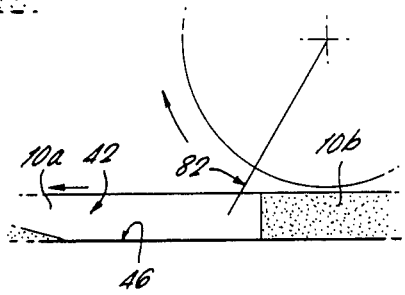
Figure 6J:
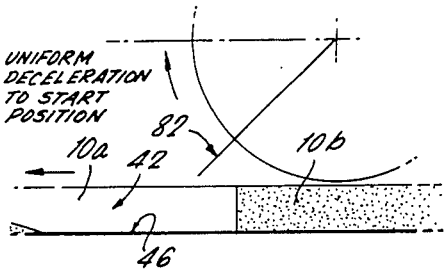

From the position shown in FIG. 6*g* the roll 110 traverses the fall 130 and the blade 82 retires in advance of the leading end of a subsequent tile portion 10*b* to the position shown in FIG. 6*j* where the roll once again engages the dwell 124 and the blade is clear of the upper surface of the subsequent tile portion 10*b*.

In order to ensure that the blade 82 retires quickly in advance of the leading end of tile portion 10*b*, the piston of the piston and cylinder arrangement 132 is pressurised as the roll 110 reaches the end of the dwell 128 whereby the connecting rod 98 is moved downwardly and to the left, as seen in FIG. 3, and the cam 106 moves freely on the bearing 109 until the stud 122 is contacted by the abutment 117. As the roll 110 reaches the dwell 124, the abutment 114 catches up with the stud 116 and a subsequent cutting cycle of the channelling tool commences.

The channels 40, cut by the blade 82 as hereinbefore described, are slightly undersize and after the ribbon of mortar on the pallets P has been cut by the knife or by knives of the vertically reciprocating mechanism 54 in known manner, the pallets P are engaged by associated dogs 194 of a drive chain 196, see FIGS. 3 and 5, driven at suitable speed from the drive motor 71 via the driven shaft 162. From FIG. 3, it will be appreciated that the distance between the dogs 194 is selected so that they separate each pallet P from the one in front, whereby the pallets P and their green state tiles 10 are arranaged in a spaced relationship as they approach and pass under the smoothing roll attachment 56.

The attachment 56 is operated by the cam 160 to cause the driven roll 140 to move downwardly into cutting and smoothing engagement with the undersized channel 40 defined in the upper surface of the tiles 10 by the blade 82. The cutting action is performed by the previously mentioned slots 140*d* in the surface of the smoothing roll.

It will be appreciated from FIG. 5 that the shape of the roll 140 will ensure that the channel 40 is provided with its angled side walls 42 and 44.

To ensure accurate cutting and smoothing of the channel in each tile, it is necessary that the various sections of the apparatus described herein are run in synchronism. To this end the motor drive controlling the drive chain 70 is also connected by appropriate means to the driven shafts 108 and 162 (see FIG. 3), thereby controlling the cams 106 and 160 and the drive chain 196.

Modifications may be made within the scope of the invention to the apparatus disclosed herein. For example, the piston and cylinder arrangement associated with the connecting rod 98 may be replaced by any suitable quick return mechanism, as indeed may the spring associated with the platen 46. In addition, although not described herein the smoothing roll 140 may be caused to vibrate to ensure a smoother finish to the channel 40.

In the embodiment described above it will be appreciated that the recess forming step performed by the channelling device 52 is disposed immediately downstream of the extruding step and before the ribbon cutting step performed by the knife mechanism 54.

In another embodiment the channelling device 52 is disposed downstream of the knife mechanism 54, whereby the recess in each tile is cut after the ribbon has been cut by the knife mechanism into discrete lengths. In this case the channelling device may still operate on the trailing end of each tile. Alternatively, the pallets and tiles thereon may first be turned through 180° in order that the channelling device may operate on the leading end of the tile. In both arrangements it is still preferred that the channelling blade 82 is moved in the direction opposed to, i.e. against, the direction of movement of the tiles with a conveyor being provided to carry away the material removed from each tile. However, should the channelling blade 82 be moved in the same general direction as the tiles, the material removed from each tile may be allowed to fall away through the gap between that tile and the adjacent tile, which tiles have by then been separated by the dogs 194 on the drive chain 196.

A further modification comprises employing the channelling tool or other recess forming tool to cut an appropriate recess at a required position intermediate the ends of each tile.

Similarly in some circumstances it may be desired to employ a recess forming tool having a rotary movement instead of a reciprocatory movement, for example, in the case in which it is desired to cut a recess having a lead-in at both ends of the recess, or, as described above, the recess is being cut at one end of the tile after adjacent tiles have been separated one from the other.

We claim:

1. A method of manufacturing roof tiles comprising the steps of first extruding continuous shaped ribbon of tile forming material onto a succession of moving pallets and subsequently cutting and forming the material into individual green state tiles on pallets with a recess formed in the upper surface of each tile over only part of its length, wherein the method of forming said recess includes the steps of causing a recess cutting tool to engage with the upper surface of the ribbon to penetrate the ribbon downwardly against the direction of movement of the ribbon to cut an inclined portion of the recess, causing said cutting tool to remain at a predetermined depth while moving relative to the ribbon to cut a floor portion of the recess, and moving the cutting tool to a retracted position, and removing the material cut from the recess to a position remote from the tile.

2. A method as claimed in claim 1 wherein the method of forming said recess comprises the steps of causing the recess cutting tool to move reciprocatorily from a retracted position to positions where it engages and penetrates the ribbon, the step of moving the cutting tool to a retracted position is performed by reversing its direction of movement in advance of the movement of the ribbon, thereby cutting out a portion of the ribbon to form said recess.

3. A method as claimed in claim 1 wherein the material cut from the recess is passed upwardly in relation to the cutting tool and moved onto a conveyor which conveys the material to a position remote from the tile.

4. A method as claimed in claim 1, wherein, during the recess forming step, at least part of the tile forming material disposed adjacent the material engaged by the recess cutting tool is mechanically supported to resist deformation of said adjacent material.

5. A method as claimed in claim 1 wherein the recess formed by the recess cutting tool in the upper surface of each tile is a channel extending lengthwise of the tile but across only part of the width of the tile.

6. A method as claimed in claim 1 wherein the recess forming step is performed at the trailing end of each tile in such a manner that the leading end of the succeeding tile is unimpaired.

7. A method as claimed in claim 1, wherein the recess forming step is performed on sucessive tile portions of the ribbon before the ribbon is cut into discrete lengths.

8. A method as claimed in claim 5, wherein the last stage of the extruding step includes passing the ribbon being formed beneath a stationary slipper in conventional manner, and the recess forming step is performed immediately downstream of the extruding step, said slipper serving to provide support and thereby resist undesired movement of the ribbon material upstream of the material being removed.

9. A method as claimed in claim 1 wherein the recess forming step is performed after the ribbon has been cut into discrete lengths and the individual tiles have been spaced apart, the recess forming step being performed at the leading end of each tile.

10. A method as claimed in claim 1, including, subsequent to the recess forming step, the additional step of causing a smoothing tool to engage with the surface of the recess in each tile.

11. A method as claimed in claim 10, wherein, during the smoothing step, at least part of the tile disposed adjacent the recess is mechanically supported to resist deformation thereof.

12. Apparatus for maufacturing roof tiles comprising means for extruding a continuous shaped ribbon of tile forming material onto a succession of moving pallets, means for subsequently cutting and forming the material into individual green state tiles on pallets, recess forming means for forming a recess in the upper surface of each tile over only part of its length, said means for forming said recess including tool moving means for moving a recess cutting tool into engagement with the upper surface of the ribbon to penetrate the ribbon downwardly against the direction of movement of the ribbon to cut an inclined portion of the recess, said tool moving means causing said cutting tool to remain at a predetermined depth while moving relative to the ribbon to cut a floor portion of the recess, and said tool moving means moving the cutting tool to a retracted position, and means for removing the material cut from the recess to a position remote from the tile.

13. Apparatus as claimed in claim 12 wherein the recess forming means is operated in synchronism with the pallets, said tool moving means including quick return means for returning the tool to its original position at the completion of its cutting action by reversing its direction of movement in advance of the movement of the tile, thereby to cut out a portion of the tile to form said recess.

14. Apparatus as claimed in claim 17 wherein the blade is mounted on the support such that the material cut by the blade passes upwardly between the blade and the support onto the means for removing said cut material.

15. Apparatus as claimed in claim 12, including support means arranged to give support during the recess forming step to at least part of the tile forming material disposed adjacent the material engaged by the recess cutting tool, and thereby resist deformation of said adjacent material.

16. Apparatus as claimed in claim 12 wherein the recess cutting tool is a channelling tool which forms a channel extending lengthwise of each tile but across only part of the width of the tile.

17. Apparatus as claim in claim 12 wherein the recess cutting tool is a blade mounted transversely of the ribbon and carried by a support which allows the blade to move along an arcuate path to effect its cut in a direction opposite to the direction of movement of the ribbon.

18. Apparatus as claimed in claim 12, wherein the recess cutting tool is cam activated, the shape of the cam determining the depth of cut at any given point along the length of the tile.

19. Apparatus as claimed in claim 12 including conveyor means associated with the recess cutting tool to carry away the material removed thereby,

20. Apparatus as claimed in claim 12 wherein the recess cutting tool is disposed immediately downstream of the extrusion means and prior to the ribbon cutting means.

21. Apparatus as claimed in claim 12 wherein the recess cutting tool is disposed downstream of the ribbon cutting means.

22. Apparatus as claimed in claim 12 wherein downstream of the ribbon cutting means, conveyor means are provided for transporting the tiles, the conveyor means having dogs disposed at a distance one from the other which dogs effect a separation of successive pallets and the tiles thereon.

23. Apparatus as claimed in claim 12 including a smoothing tool disposed above the tiles and operable to effect a smoothing action on the surface of the recess in each tile.

24. Apparatus as claimed in claim 23, including support means arranged to give support during the smoothing step to at least part of the tile disposed adjacent the recess, and thereby resist deformation thereof.

25. Apparatus as claimed in claim 23 wherein the smoothing tool is a roll extending transversely to the direction of movement of the tiles, there being provided drive means for rotating the roll in a direction opposite to the direction of movement of the tiles, and control means to engage and disengage the roll with each tile in synchronism therewith.

26. Apparatus as claimed in claim 25 wherein the control means is a driven cam, the shape of the cam determining the vertical position of the smoothing roll relative to the tile beneath.

* * * * *